US008459750B2

(12) United States Patent
Antoline et al.

(10) Patent No.: US 8,459,750 B2
(45) Date of Patent: Jun. 11, 2013

(54) ANCHORING DEVICE AND METHOD FOR FIXATION OF A LAUNCHING UNIT FOR HIGHWALL MINING

(75) Inventors: Steven Allen Antoline, Mt. Lookout, WV (US); Paul Emile Van Es, Helvoirt (NL); Cornelis Wilhelm in 't Hout, Gouda (NL)

(73) Assignee: Caterpillar Global Mining Highwall Miners LLC, Beckley, WV (US)

( * ) Notice: Subject to any disclaimer, the term of this patent is extended or adjusted under 35 U.S.C. 154(b) by 54 days.

(21) Appl. No.: 11/721,476

(22) PCT Filed: Jan. 14, 2005

(86) PCT No.: PCT/NL2005/000024

§ 371 (c)(1),
(2), (4) Date: Jan. 25, 2008

(87) PCT Pub. No.: WO2006/075910

PCT Pub. Date: Jul. 20, 2006

(65) Prior Publication Data

US 2008/0120926 A1 May 29, 2008

(51) Int. Cl.
*E02D 5/74* (2006.01)

(52) U.S. Cl.
USPC ..... 299/64

(58) Field of Classification Search
USPC ..... 405/231, 232, 245, 249, 253, 259.1, 405/244, 236, 243, 248; 299/18, 67, 64; 175/162, 402, 403, 404, 405, 405.1; 52/157, 52/158; 173/105, 108
See application file for complete search history.

(56) References Cited

U.S. PATENT DOCUMENTS

| | | | | |
|---|---|---|---|---|
| 3,291,229 | A * | 12/1966 | Houston | 175/60 |
| 3,467,209 | A * | 9/1969 | Chromy | 175/395 |
| 4,744,699 | A * | 5/1988 | Price et al. | 405/259.5 |
| 5,112,111 | A * | 5/1992 | Addington et al. | 299/18 |
| 5,399,055 | A * | 3/1995 | Dutton, Jr. | 405/230 |
| 5,425,188 | A * | 6/1995 | Rinker | 37/317 |
| 5,555,947 | A | 9/1996 | Bunker et al. | |
| 6,131,674 | A | 10/2000 | Draney et al. | |
| 6,216,803 | B1 | 4/2001 | Deken | |
| 6,497,296 | B1 | 12/2002 | McGriff et al. | |
| 6,543,966 | B2 * | 4/2003 | White | 405/232 |
| 6,652,035 | B2 | 11/2003 | Chisholm | |
| 2002/0044839 | A1 * | 4/2002 | Mosing et al. | 405/231 |
| 2007/0110521 | A1 * | 5/2007 | Nimens | 405/232 |

FOREIGN PATENT DOCUMENTS

| | | | |
|---|---|---|---|
| JP | 56119032 | A * | 9/1981 |
| JP | 58054127 | A * | 3/1983 |
| JP | 63284324 | A * | 11/1988 |

OTHER PUBLICATIONS

PCT/NL2005/000024; PCT International Search Report mailed Sep. 14, 2005.

* cited by examiner

*Primary Examiner* — Sunil Singh

(57) ABSTRACT

The invention relates to an anchoring device (1) for fixation of a launching unit (50) for highwall mining. The invention also relates to a cylindrical body (2) for use in such an anchoring device. Moreover, the invention relates to a launching unit (50) provided with at least one anchoring device (1) and to methods of fixation and relocation of a launching unit (50). The invention provides an increased stability of launching units (50) for highwall mining.

15 Claims, 4 Drawing Sheets

ANCHORING DEVICE AND METHOD FOR FIXATION OF A LAUNCHING UNIT FOR HIGHWALL MINING

This application is a national phase of International Application No. PCT/NL2005/000024 filed Jan. 14, 2005 and published in the English language.

The invention relates to an anchoring device for fixation of a launching unit for highwall mining. The invention also relates to a cylindrical body for use in such an anchoring device. Moreover, the invention relates to a launching unit provided with at least one anchoring device and to methods of fixation and relocation of a launching unit.

Highwall mining is conducted for removing coal, or minerals, ores or other materials in seams or veins under an overburden too deep to justify strip mining but which may be accessed from an exposed edge of the seam or vein. Highwall mining is applicable where the appropriate machinery can be placed in a cut or bench to extend a cutter head, followed by a train of conveyor segments for transporting mined material out of the mine shaft created by the cutter head. A commercially successful highwall mining apparatus is described in U.S. Pat. No. 6,042,191 to Antoline and van Es. U.S. Pat. No. 6,042,191 includes a description of a launching unit for adding conveyor units to a train. As there is a tendency to highwall mining with increasing mine lengths and/or increased speed, the launching unit has to handle increasing forces and thus there is a demand for increased stabilisation of the launching unit. The launching unit delivers the power to, push or to pull the cutter head and train of conveyor segments in or out of the mine shaft and for the best results the launching unit is maintained in a stable position during an entire mining operation. Longer trains mean increasing mass to be handled. Further, position control of a cutter head on the front end of the train of conveyor segments is requested to optimise the mining of coal seams and veins of ore. Another aspect is safety. As multiple mine shafts are cut parallel, and these shafts stretch out over great distances (up to kilometres), a lack of precision in the direction of a mine shaft may lead to weak areas in the mined wall, which could lead to collapse of rock resulting in the loss of equipment and production. The direction of mining by a cutter head of a train of conveyor segments is largely determined by the position and orientation of the launching unit. All these aspects of highwall mining lead to a demand for improved stabilisation of a high wall launching unit.

The invention aims to provide means and a method for realising an increased stability of a launching unit for highwall mining.

In order to accomplish this aim, the invention provides an anchoring device for fixation of a launching unit for highwall mining comprising a hollow cylindrical body to be axially driven into a surface, wherein a distal end of the cylindrical body is provided with a cutting edge. Such an anchoring device may be driven into a surface in order to stabilise the launching unit by absorption of motions and vibrations, thus enabling a safer and more precise operation of the launching unit and direction of the cutter head. The hollow cylindrical body is driven into the surface, resulting in a situation wherein a part of the cylindrical body is filled with surface matter such as for instance rock, debris and/or mud. Thus, the launching unit is fixed and immobilized on the surface. The filled hollow cylindrical body has excellent vibration- and motion-absorbing properties. Due to the wide diameter of the cylinder the cylindrical body is well designed to lead forces exerted on the launching unit to the surface. A cylindrical body combines a relative high compression and bending strength with a relative limited weight. Also as the cylindrical body is filled it has a high buckling resistance. Moreover, the hollow cylindrical shape is easier to drive into rocky soil, and is also easier to remove from the surface, thus enabling both the rapid relocation and the rapid fixation of a launching unit. The cutting edge may be adapted to the type of surface that the anchoring device is used in. Mining areas typically contain hard bottoms such as rock and sandstone, and relatively soft bottoms such as coals and/or mud.

It is advantageous if the anchoring device also comprises coupling means for coupling the cylindrical body to the launching unit. Thus, an anchoring device may be easily attached to the launching unit by the coupling means. Alternatively, the coupling means are integrated in the launching unit. The coupling means may comprise a clamp or beam that may be attached to the anchoring device, for instance by bolts.

In a preferred embodiment, the coupling means comprise locking means for locking the cylindrical body in at least one specific position relative to the launching unit. Thus, the cylindrical body may for instance be locked in an inactive position during relocation of the launching unit minimising hindrance during transport. Also the cylindrical body can optionally be locked in its position after the cylindrical body has been driven into the ground, thus ensuring that the immobilised position and orientation of the launching unit is maintained.

It is also preferred if the anchoring device comprises driving means for axial driving of the cylindrical body. Thus the cylindrical body may be rapidly driven into a surface for stabilising the launching unit thereon. The driving means may for instance comprise a hydraulic cylinder or pneumatic hammer for pushing, vibrating or hammering the cylindrical body into the surface or pulling it upwards in order to remove it out of the surface. Alternatively, the cylindrical body may be driven by driving means independent of the launching unit and/or the anchoring device, for instance a pile-driver.

In a yet another preferred embodiment the anchoring device also comprises driving means for axial rotation of the cylindrical body in co-operation with the axial driving. Axial rotation of the cylindrical body makes the axial driving easier, thus enabling faster and more efficient axial driving. Axial rotation also makes it easier to pull the cylindrical body out of the surface. The driving means for rotation around the axis of the cylinder may for instance be an electric, pneumatic or hydraulic power drill swivel, preferably located at the end of the cylindrical body away from the cutting edge. In a preferred embodiment, the driving means for axial rotation are an integrated system with the driving means for axial driving, thus leading to efficient axial driving of the cylindrical body into the surface.

It is also preferred that the anchoring device comprises guiding means for guiding axial displacement of the cylindrical body. The guiding means enable a more precise axial driving, as well as a more efficient use of the power used to move the cylindrical body. The guiding means may at the same time guide rotational movements of the cylindrical body. The guiding means may for instance comprise a number of lined-up guiding elements like rings and/or casings that engage the cylindrical body.

Furthermore it is preferred that the cylindrical body is detachably connected to the anchoring device. Thus, the cylindrical body can easily be replaced. This also facilitates a rapid and easy method to mobilize a fixed launching unit by releasing a cylindrical body stuck in the surface from the launching unit, enabling relocation and immobilization of the launching unit by a replacement cylindrical body.

In yet another preferred embodiment, the radial thickness of the cutting edge is larger than the radial thickness of the cylindrical body. Such a cylindrical body is relatively easy to drive axially into the surface, especially when deep anchoring is to be realised. Radial thickness is the dimension of outside-face to the inside face of the cylindrical body, measured from the axis of the cylindrical body.

In again another preferred embodiment, the cutting edge is jagged. A jagged cutting edge makes the axial driving of the cylindrical body easier, thus saving power and time. The jagged edge is especially effective when the cylindrical body is being rotated around its axis to be driven axially into the surface.

It is also preferred that the anchoring device is provided with at least one support member for resting on the surface. Such a support member enables an easier method of orienting and tuning of the direction of the cylindrical body as well as the launching unit the anchoring device is attached to. The support member may be used to stabilize the position of the launching unit while the cylindrical body is being driven into the surface, thus improving the precision in the initial positioning of a launching unit. The support member may for instance be a jack or reliever that is may be arrested at any desired adjustable vertical height for orienting the launching unit.

Preferably, the support member is provided with driving means for displacement of the support member with respect to the surface. The orientation of the launching unit may be rapidly accomplished. The driving means for the support member may for instance be an hydraulic or pneumatic cylinder for movement and fixation of the support member.

In a preferred embodiment, the anchoring device is provided with a vacuum system for instantaneous removal of debris produced by the cutting edge during driving the hollow cylindrical body into the surface. Such a vacuum system enables more comfortable and faster drilling of the cylindrical body into the surface. Moreover, the vacuum system lowers levels of dust and other debris around the location, and thus ensures a healthier and safer working environment. The debris is usually transported by the vacuum system to a debris collection device. The vacuum system may remove the debris as such, but may also incorporate a water-supply system for delivery of water to the cutting edge. In this case, the water mixes with the debris produced by the cutting edge during operation, and resulting sludge is sucked up and transported by the vacuum system. Such a water system diminishes dust levels during the driving of the hollow body, and also cools the cutting edge, enabling faster driving of the cylindrical body.

The invention also provides a cylindrical body for use in an anchoring device as discussed above, wherein the cylindrical body is essentially hollow, and wherein a distal end of the cylindrical body is provided with a cutting edge. The cylindrical body may be fitted into an anchoring device according the invention, and offers excellent anchoring properties as described above. In case of wear of a cylindrical body it can be replaced for another.

The invention further provides a launching unit for highwall mining comprising at least one anchoring device as discussed above. Such a launching unit may be fixed accurately in a desired orientation, thus ensuring that the cutter head of a train of conveyor segments launched by the launching unit is directed reliable into the desired part of the wall to be mined, for instance a rich vein of ore.

Preferably, the launching unit comprises multiple anchoring devices according the invention. Thus the precision and stability of the launching unit is further improved. Also, multiple anchoring devices make it easier to accomplish to anchor an orientation of the launching unit. Further, the use of multiple anchoring devices improves safety, as failure of one of the anchoring devices may be countered by the remaining anchor device or devices.

The invention further provides a method for stabilisation of a launching unit for highwall mining, comprising the process steps: positioning and orientation of the launching unit on a surface, and fixation of the launching unit by driving at least one anchoring device according the invention into the surface, wherein the anchoring device is coupled to the launching unit. Said method enables more efficient mining, as the launching unit thus fixed remains in the desired orientation in order to keep the cutter head in the preferred mining direction. Further, the method according the invention is safer than methods known in the art. For further advantages of this method see the advantages of the anchoring device according the present invention.

It is preferred if debris produced by the cutting edge during driving the hollow cylindrical body into the surface is instantaneously removed using a vacuum system. As described above, the use of such a vacuum system gives the advantages of a healthier and safer working environment, as well as enabling rapid placement of the cylindrical body into the soil. The debris is usually transported by the vacuum system to a debris collection device. The vacuum system may be connected to the anchoring device, but may also from an independently operated unit.

The invention also provides a method of relocating a launching unit stabilized by an anchoring device driven into the surface according the invention, comprising the steps: pulling the cylindrical body free from the surface, and moving of the launching unit. Thus, relocation of the launching unit is comfortably achievable. The launching unit may be oriented and fixed again with the same cylindrical bodies in order to start mining a new shaft. The cylindrical bodies can be used multiple times.

The invention further provides a method of relocating a launching unit stabilized by an anchoring device driven into the surface according the invention, comprising the following steps: cutting of the hollow cylindrical body, leaving a part of the cylindrical body stuck in the surface, and moving of the launching unit. Such method makes it very easy to rapidly release a fixed launching unit from a location, thus saving valuable time. The cut part of the cylindrical body may be left in the ground, or may be recovered at a later time.

The present invention will be further elucidated on the basis of the non-limitative exemplary embodiments shown in the following figures, wherein.

Figure 1B:
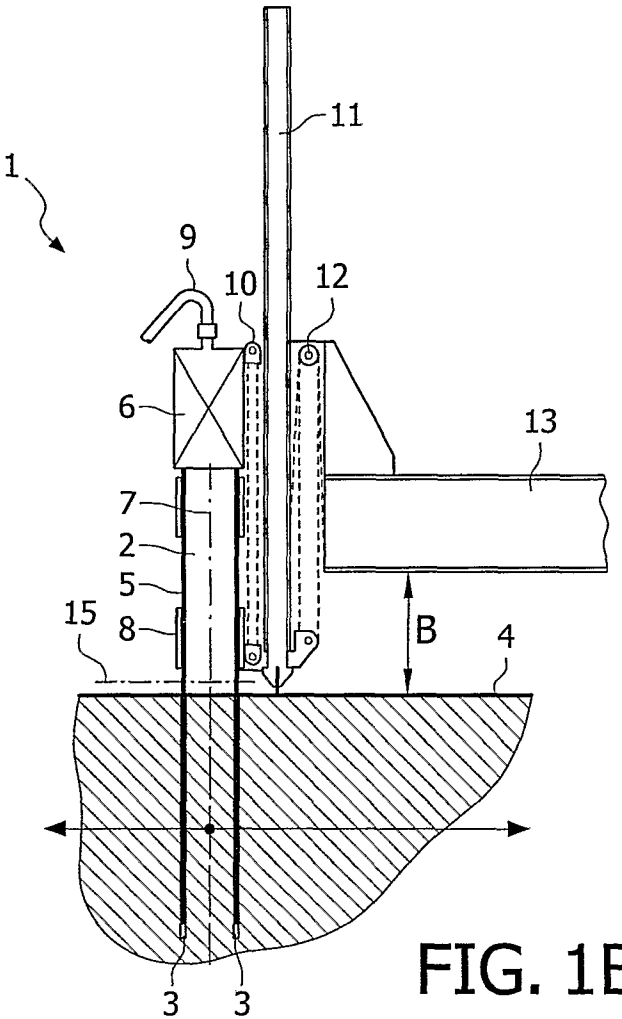
FIGS. 1A and 1B show an example of an anchoring device according the invention.
Figure 1A:
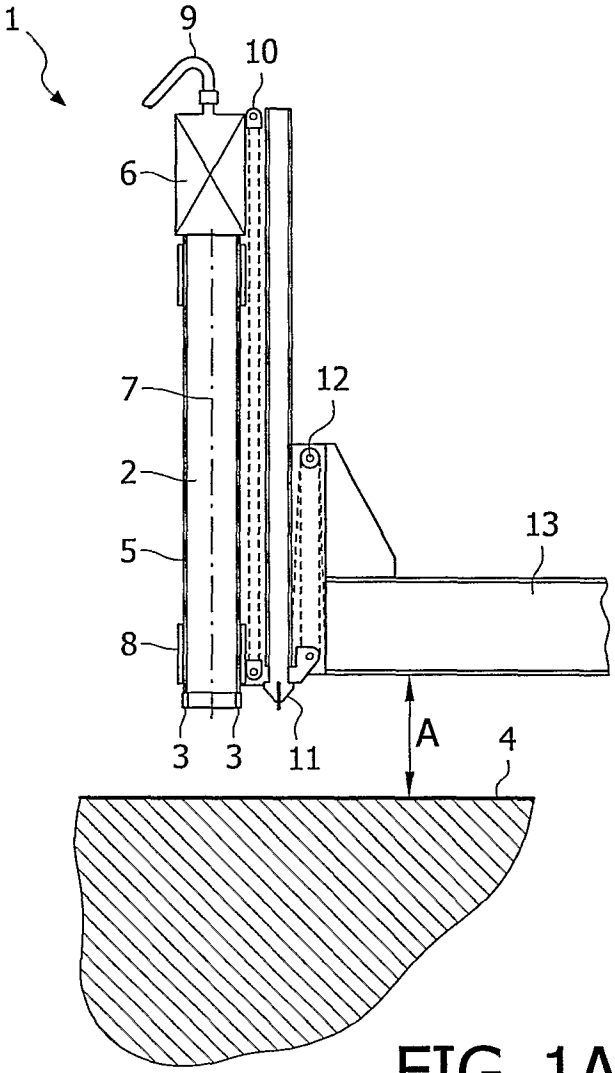

FIG. 1A shows an anchoring device 1 according the invention in a inactive ("pulled out") configuration. The anchoring device 1 comprises a hollow cylindrical body 2 provided with a cutting edge 3 for cutting into a surface 4. The cutting edge 3 is thicker than the wall 5 of the cylindrical body 2, making is easy to drive the cylindrical body 2 into the surface 4. The anchoring device 1 is provided with a drill swivel 6 for driving the hollow cylindrical body 2 into the surface 4 in the direction of the axis 7 of the cylindrical body 2. A guide casing 8 around the cylindrical body 2 assists in aligning the cylindrical body 2 when it is drilled into the surface 4 by the drill swivel 6. The drill swivel 6 is connected to an electric or hydraulic power line 9, depending on the type of the power drill swivel 6 used, causing a rotation around the axis 7 of the cylindrical body 2 while it is driven into the ground 4, assisted by the vertical motion of powered linear motion system 10. Further, the cutting edge 3 is a jagged edge, making the rotating movements of the cylindrical body around the axis 7 more effective for driving the cylinder 2 into the rock 4. The drill swivel 6 is detachable from the anchoring device 1, so that the same drill swivel 6 may be used in multiple anchoring devices 1. The power drill swivel 6 is mounted on a powered linear motion system 10 for moving the drill swivel 6 downwards while drilling the cylindrical body into the surface 4. The powered linear motion system 10 also incorporates a locking means for keeping the cylindrical body in a desired position. Further, the anchoring device 2 is provided with a jack support 11 connected to a second powered linear motion system 12 for vertical positioning of the support 11. In this figure, the support 11 is in a pulled-up position, wherein it is not touching the ground 4. The anchoring device 1 is coupled to a mining launch unit (not shown) by a beam 13 that conveys reaction forces and loads, including vibrations and shock loads, to the anchoring device 1. The jack support 11 is used during drilling to fix the vertical distance A of the anchoring device 1 with respect to the surface 4, and to bear weight and absorb all kinds of vertical loads of the mining launching unit. The anchoring device may be equipped with a system for the extraction of drill cuttings and drill dust from the working area, preferably a vacuum system.

FIG. 1B shows the anchoring device 1 from FIG. 1 in a fixed, 'drilled in' position. The labels in FIG. 1B correspond with those in FIG. 1A. The drill swivel 6 in co-operation with the hydraulic cylinder 10 has drilled the hollow cylindrical body 2 into the surface 4, resulting in a situation where part of the cylindrical body 2 is filled with soil material 4, thus increasing the solidity of the anchoring. As the cylinder 2 is hollow, little ground material needs to be displaced, thus making the drilling process relatively easy compared to anchoring with a solid body. As the cylindrical body 2 has a relatively broad diameter, the anchoring is especially effective in absorbing sidewards or horizontal vibrations and movements. For vertical movements and vibrations, the jack support 11 has been lowered by the hydraulically operated telescopic cylinder 12 to bring the anchoring device 1 to the desired height B. Thus, the jack support 11 is capable of bearing part of the weight and to absorb and dampen vertical shocks and vibrations, causing a greater stability. In this particular embodiment, the cylinder that moves the jack support 11 simultaneously moves the guiding casing 8 that guides the wall 5 of the cylindrical body 2 during the drilling of the body 2 into the ground 4. When the launching unit (not shown) is to be relocated, the cylindrical body 2 may be pulled out of the ground 4 by a reversed movement. This may be achieved by co-operation of the hydraulical cylinders 10,12 for upward movement, preferably in combination with a rotational movement of the cylinder 2 around its axis 7, induced by the drill swivel 6, in order to make it easier to pull the anchoring body 2 free. Alternatively, the cylindrical body 2 may be cut, for instance according dotted line 15, thus releasing the anchoring device 1 and leaving part of the cylindrical body 2 in the ground 4. Preferably, the cylindrical body 2 is cut off just above the ground, to ensure that the part stuck in the ground does not hamper the movement of vehicles, in particular the movement of the launching unit. This method is obviously quicker than the first one, although then the cylindrical body 2 will have to released from the anchoring device 1 in order to provide room for a replacement cylindrical body 2.

Figure 2C:
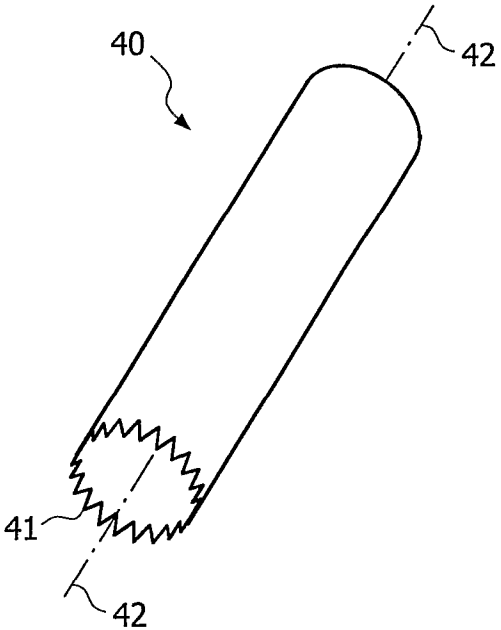
FIGS. 2A-C shows cylindrical bodies for use in anchoring devices according the invention.
Figure 2B:
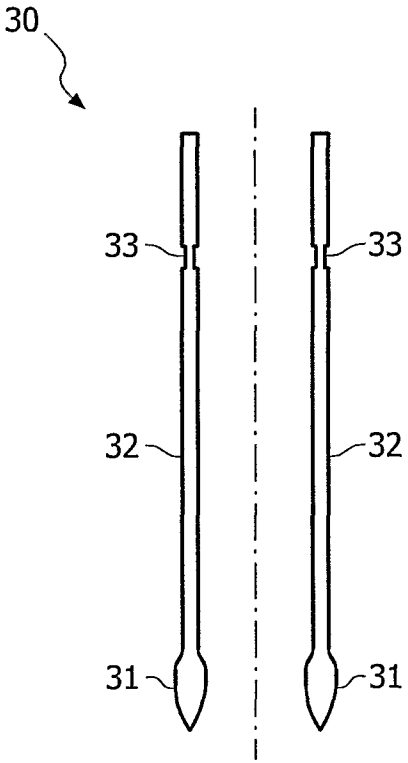
Figure 2A:
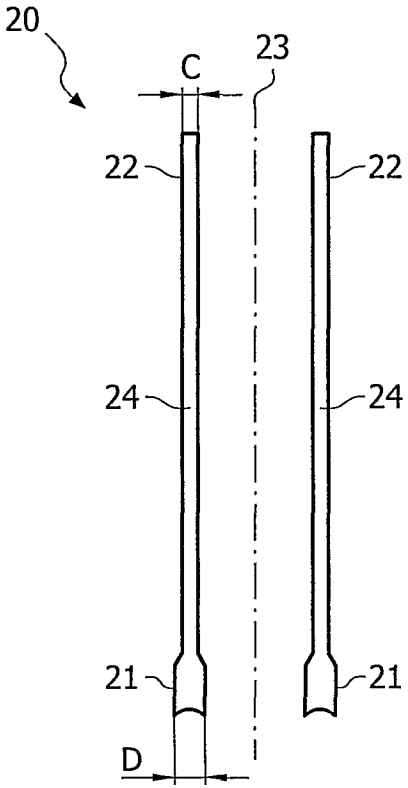

FIG. 2A shows a schematic projection of a cylindrical body 20 according the invention, such as cylindrical body 2 in FIGS. 1A and 1B. The cylindrical body 20 is comprises a cutting edge 21 at one end, whereas the opposite end has a profile 22 for gripping interaction with a drill swivel (such as the drill swivel in FIGS. 1A and 1B) for rotation of the cylinder around its axis 23. The axial thickness C of the cylinder wall 24 is smaller than the axial thickness D of the cutting edge 21, thus making the axial driving of the cylinder 20 into the ground easier in the direction of the cutting edge 21.

FIG. 2B shows another cylindrical body 30 according the invention, this one is provided with a different design of cutting edge 31. The cutting edge may 31 be chosen according the type of surface that is encountered, e.g. hard rock, soft stone, mixed soil.

Comparable to FIG. 2A, this cylindrical body 30 also has a cutting edge 31 with a greater maximum axial thickness than the rest of the cylinder 32. The cylinder 32 is provided with a weakened radial zone 33 that makes cutting of the cylinder 32 easier, enabling rapid release of the anchoring device comprising such a cylindrical body 30. The weakened zone 33 may for instance be located at the zone 15 in FIG. 1B.

FIG. 2C shows a third embodiment of a hollow cylindrical body 40 for use in an anchoring device according the invention. This cylindrical body is provided with a jagged cutting edge 41 that improves the ability of the cylindrical body to penetrate a rocky surface. The jagged teeth 41 take effect especially when the cylinder is rotated around its axis 42 while being axially driven into the ground in the direction of the cutting edge 41. The shape and material of the teeth may be adjusted to the materials of the soil. The part with jagged teeth van be replaced to exchange a worn part or to change the shape of the teeth. The part with the jagged teeth can for instance be exchanged by cutting off and welding in a new part. This can be made easier by special provisions, for instance guiding provisions for easy centralising the new part (not shown).

Figure 3:
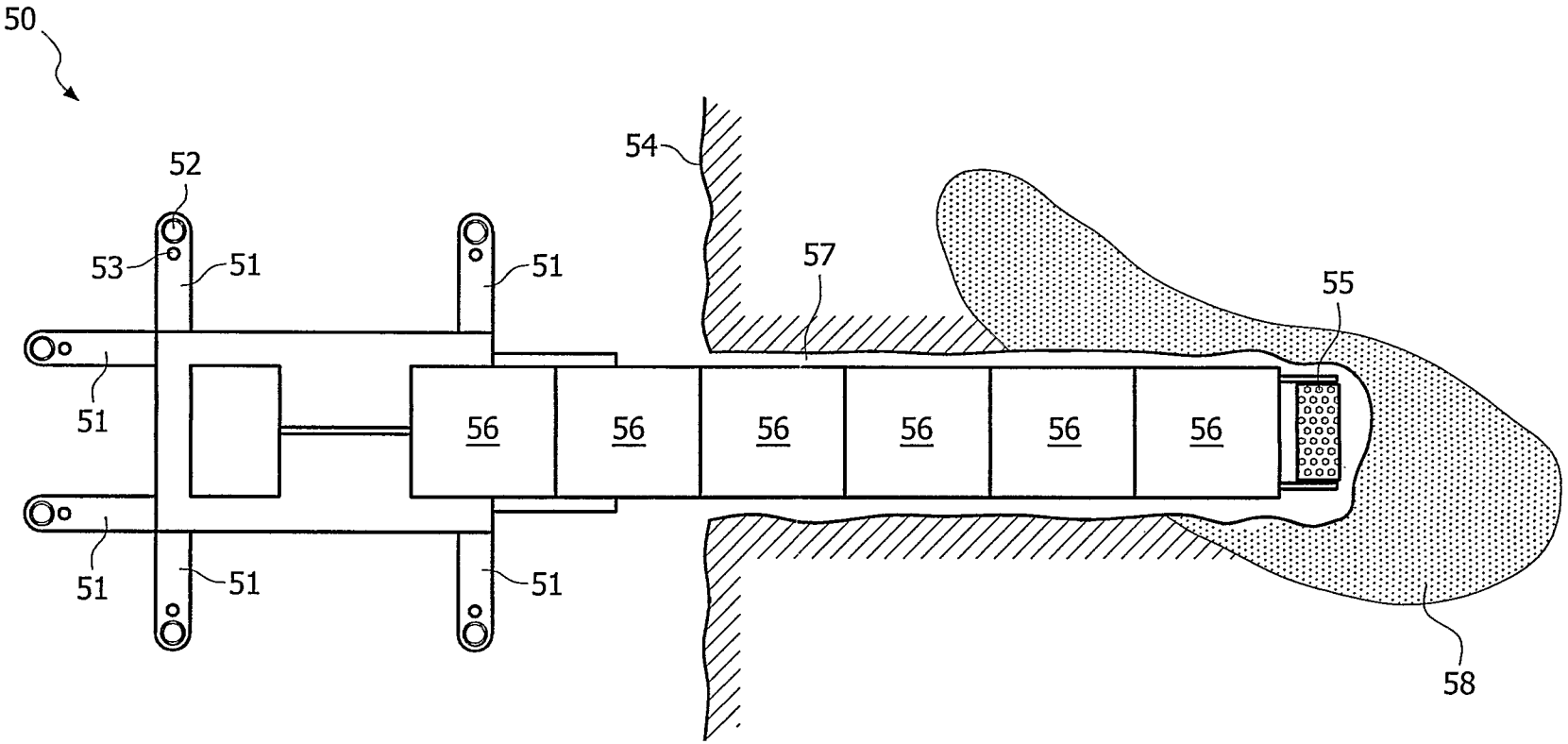
FIG. 3 shows a launching unit provided with anchoring devices according the invention.

FIG. 3 shows a top view of a launching unit 50 for highwall mining according the invention. The launching unit 50 is provided with six anchoring devices 51 according the invention, each provided with a hollow cylindrical body 52 that is partly driven into the surface below, and a support member 53 that rests upon the surface. Each anchoring device is thus in a configuration comparable to the situation depicted in FIG. 1B. The anchoring devices 52 stabilize the launching unit 50, thus maintaining the orientation of the launching unit 50 with respect to the high wall 54 that is mined. Thus, the launching unit 50 is enabled to precisely direct the cutter head 55 and the train of conveyor segments 56 in the mine shaft 57. This is very important in order to keep the cutter head 55 directed towards (for instance) a rich vein of ore 58. It is even more important that the mine shaft is oriented parallel to a previous mined entry, in order to prevent collapsing hazards. Of course the positioning and orientation of the launching unit 50 is in three dimensions, as the mine shaft 57 may be cut under an inclining or declining angle.

Figure 4:
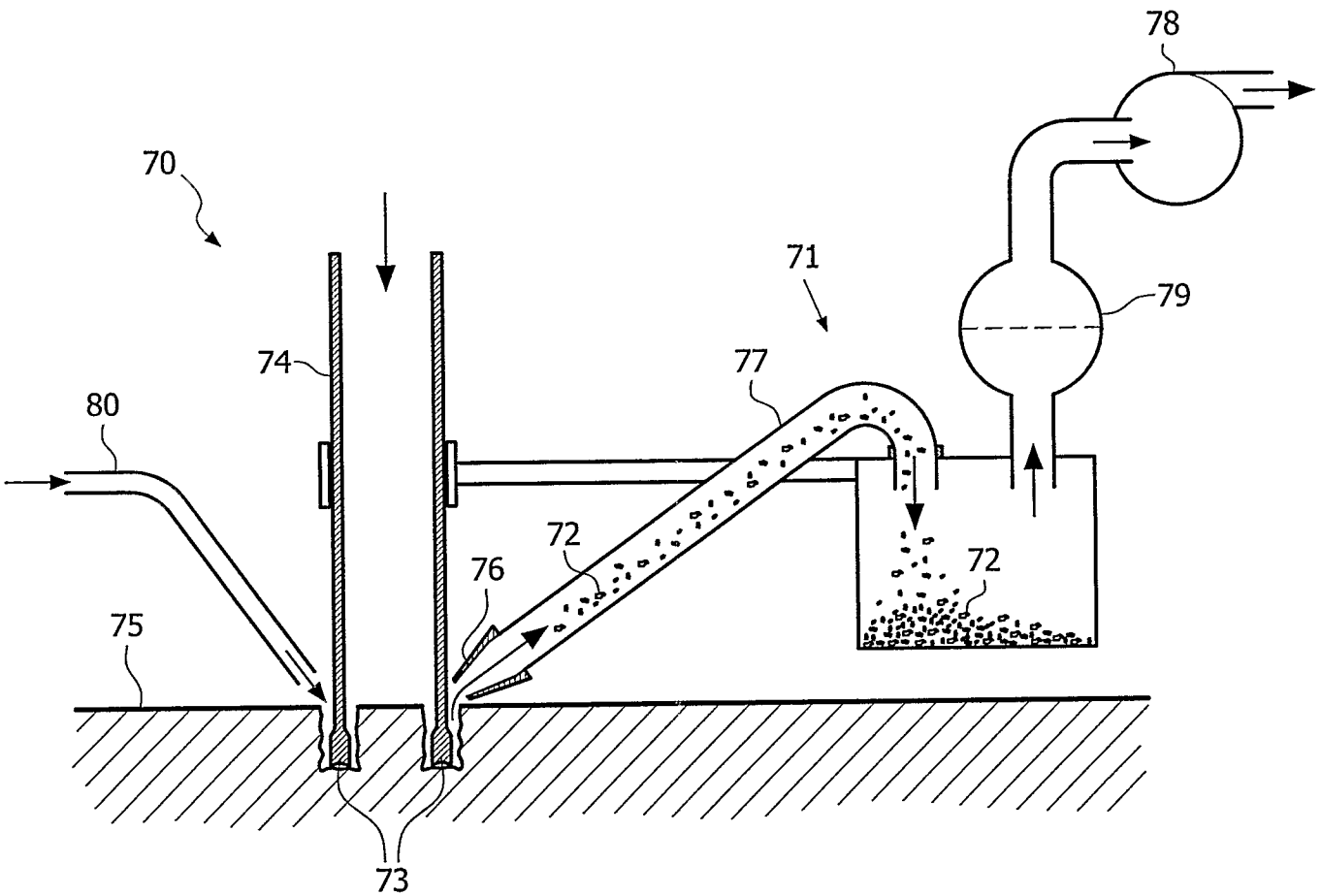
FIG. 4 shows an anchoring device according to the invention provided with a vacuum system.

FIG. 4 shows an anchoring device 70 according to the invention (comparable to any of the anchoring devices described above), provided with a vacuum system 71 for instantaneous removal of debris 72 produced by the cutting edge 73 during driving the hollow cylindrical body 74 into the surface 75. Such a vacuum system 71 enables more comfortable and faster drilling of the cylindrical body 74 into the surface 75. The vacuum system 71 comprises a suction mouth 76 positioned near the cutting edge 73 connected to a flexible transport hose 77 that connects to the debris collection bin, where the drilled debris 72 formed by soil particles removed by the cutting edge 73 are collected. The vacuum within the system 71 is maintained by a vacuum pump 78 that connects to the system through a dust filter 79 that protects the pump 78 from harmful particles. The vacuum system may be used to suck up soil particles 72 as they are formed at the cutting edge 73, but alternatively water may be dispensed by a water hose 80, in order to mix with soil particles to form sludge that is more easily sucked up and transported by the vacuum system 71. Also, added water assists the drilling by cooling the cutting edge 73, thus enabling a higher drilling pace by reducing the risk of over-heating.

For a person skilled in the art, many variations and preferred embodiments of the invention are possible.

The invention claimed is:

1. An assembly, the assembly comprising:
a launching unit for highwall mining;
an anchoring device for fixation of the launching unit; and
a coupler for coupling the anchoring device to the launching unit; the anchoring device comprising:
a hollow cylindrical body to be axially driven into a surface, wherein a distal end of the cylindrical body is provided with a cutting edge and the cylindrical body is configured to retain surface material within the hollow body in a driven position;
a linear motion system for connecting the hollow cylindrical body to the launching unit to provide for absorption of horizontal and vertical vibrations and shock loads from the launching unit while providing for raising and lowering of the hollow cylindrical body relative to the launching unit for highwall mining; and
a guide for guiding axial displacement of the hollow cylindrical body while allowing for axial and rotational movement of the cylindrical body during driving of the hollow cylindrical body into the surface.

2. An assembly according to claim 1, characterised in that the anchoring device also comprises driving means for axial driving of the cylindrical body.

3. An assembly according claim 2, characterised in that the anchoring device also comprises driving means for rotation of the cylindrical body around the axis of the cylinder in cooperation with the driving means for axial driving.

4. An assembly according to claim 1, characterised in that the cylindrical body is detachably attached to the linear motion system.

5. An assembly according to claim 1, characterised in that the radial thickness of the cutting edge is greater than the radial thickness of the cylindrical body.

6. An assembly according to claim 1, characterised in that the cutting edge is jagged.

7. An assembly according to claim 1, characterised in that the anchoring device is provided with at least one support member for resting on the surface.

8. An assembly according claim 7, characterised in that the support member is provided with a drive for displacement of the support member with respect to the surface.

9. An assembly according to claim 1, characterized in that the anchoring device is provided with a vacuum system for instantaneous removal of debris produced by the cutting edge during driving the hollow cylindrical body into the surface.

10. An assembly, comprising: a launching unit for highwall mining, a launching unit anchor that is used to anchor the launching unit against the high lateral loads encountered by the launching unit during highwall mining, a coupler for coupling the anchor to the launching unit, the anchor comprising a cylindrical body configured to be axially driven into a surface, wherein the cylindrical body is essentially hollow so that, when the cylindrical body is driven into the surface, surface material will be retained within the cylindrical body whereby the cylindrical body will absorb horizontal vibrations and movements from the launching unit in cooperation with the surface material retained within the cylindrical body, and wherein a distal end of the cylindrical body is provided with a cutting edge, the anchor further comprising a guide for guiding axial displacement of the cylindrical body while allowing for axial and rotational movement of the cylindrical body during driving of the cylindrical body into the surface, and a drill for rotating the cylindrical body, and a linear motion system for raising and lowering the cylindrical body relative to the launching unit.

11. An assembly according to claim 10, characterised in that the assembly comprises multiple anchors.

12. A method for stabilisation of an assembly, comprising the steps:
positioning and orienting the launching unit on a surface,
fixing the launching unit by driving the anchor into the surface.

13. A method according to claim 12, further comprising instantaneously removing debris produced by the cutting edge during driving the anchor into the surface using a vacuum system.

14. A method of relocating an assembly after being stabilized by the method of claim 12, comprising the steps:
pulling the anchor free from the surface, and
moving of the assembly to a new location.

15. A method of relocating an assembly after being stabilized by the method of claim 12, comprising the steps:
cutting of the anchor, leaving a part of the anchor stuck in the surface, and
moving of the rest of the assembly to a new location.

* * * * *